US009002250B2

(12) United States Patent
Matsumoto et al.

(10) Patent No.: US 9,002,250 B2
(45) Date of Patent: Apr. 7, 2015

(54) FIXING DEVICE AND IMAGE FORMING APPARATUS

(71) Applicant: Fuji Xerox Co., Ltd., Minato-ku, Tokyo (JP)

(72) Inventors: Mitsuhiro Matsumoto, Kanagawa (JP); Yasuhiro Uehara, Kanagawa (JP); Kazuyoshi Ito, Kanagawa (JP); Taketoshi Higashi, Kanagawa (JP); Kenji Sawai, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/912,361

(22) Filed: Jun. 7, 2013

(65) Prior Publication Data

US 2014/0105656 A1 Apr. 17, 2014

(30) Foreign Application Priority Data

Oct. 15, 2012 (JP) ..... 2012-228167

(51) Int. Cl.
*G03G 15/20* (2006.01)

(52) U.S. Cl.
CPC ..... *G03G 15/2053* (2013.01); *G03G 15/2057* (2013.01); *G03G 2215/2035* (2013.01)

(58) Field of Classification Search
None
See application file for complete search history.

(56) References Cited

U.S. PATENT DOCUMENTS 5,119,143 A * 6/1992 Shimura ..... 399/329
2011/0217095 A1 9/2011 Ishii et al.
2011/0222930 A1* 9/2011 Fujimoto et al. ..... 399/329

FOREIGN PATENT DOCUMENTS

JP 2011-180502 A 9/2011

* cited by examiner

*Primary Examiner* — Clayton E Laballe
*Assistant Examiner* — Jas Sanghera
(74) *Attorney, Agent, or Firm* — Sughrue Mion, PLLC

(57) ABSTRACT

A fixing device includes an endless belt that fixes toner onto a recording medium by heat, a heating member in the form of substantially a sheet that has flexibility and that heats the belt from inside a space enclosed by the belt, and a stationary member including a curved surface that is in contact with the heating member, a fixed area in the curved surface in which the heating member is fixed to the stationary member, and a non-fixed area in the curved surface in which the heating member is not fixed to the stationary member, the stationary member having a coefficient of linear expansion different from that of the heating member. The belt is wound around the stationary member via a layer that includes the heating member, and rigidities of the belt and the heating member are lower than a rigidity of the stationary member.

9 Claims, 3 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2012-228167 filed Oct. 15, 2012.

BACKGROUND (i) Technical Field

The present invention relates to a fixing device and an image forming apparatus.

(ii) Related Art

A fixing device is known that fixes toner onto a recording medium by applying heat by a fixing belt to a recording medium to which a toner image has been transferred.

SUMMARY

According to an aspect of the invention, there is provided a fixing device including an endless belt that fixes toner onto a recording medium by heat, a heating member in the form of substantially a sheet that has flexibility and that heats the belt from inside a space enclosed by the belt, and a stationary member including a curved surface that is in contact with the heating member, a fixed area in the curved surface in which the heating member is fixed to the stationary member, and a non-fixed area in the curved surface in which the heating member is not fixed to the stationary member, the stationary member having a coefficient of linear expansion different from a coefficient of linear expansion of the heating member. The belt is wound around the stationary member via a layer that includes the heating member, and rigidities of the belt and the heating member are lower than a rigidity of the stationary member.

BRIEF DESCRIPTION OF THE DRAWINGS

Exemplary embodiments of the present invention will be described in detail based on the following figures, wherein.

DETAILED DESCRIPTION

Figure 1:
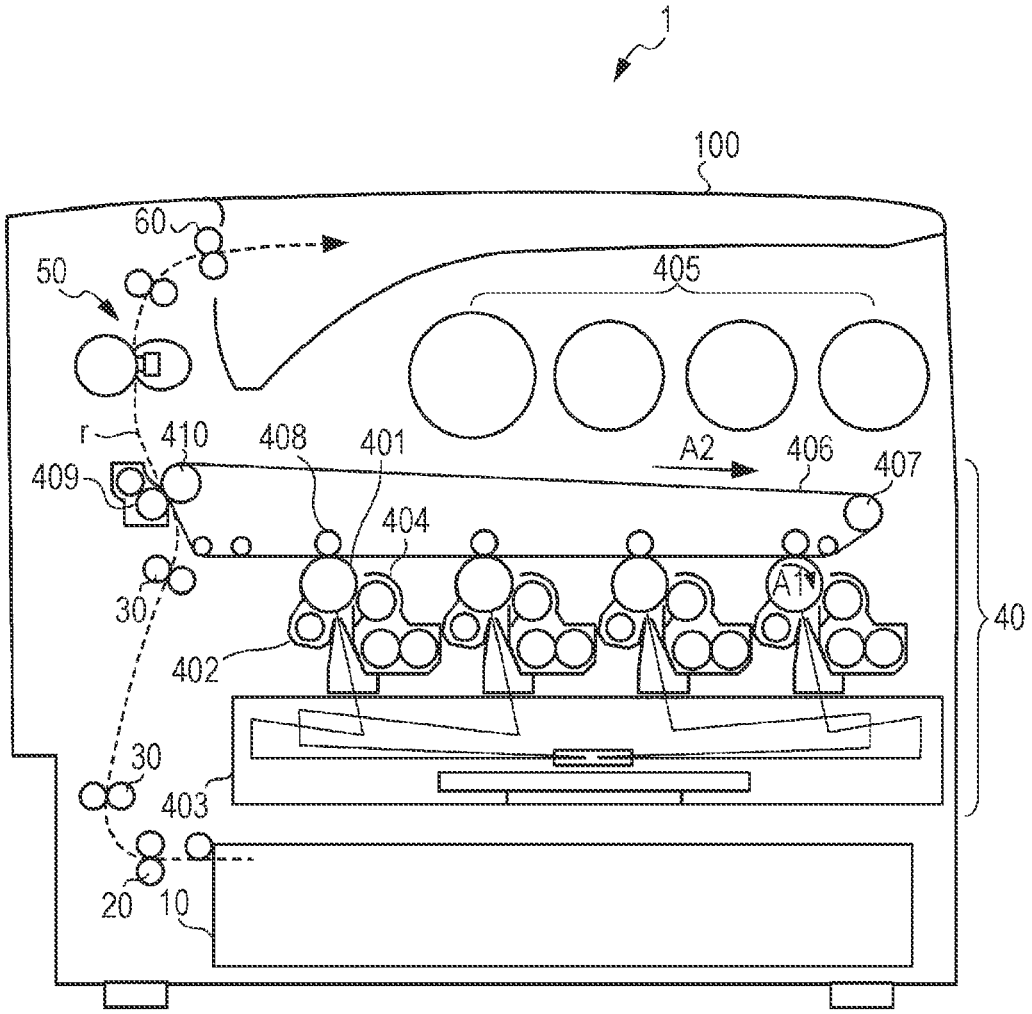
FIG. 1 is a schematic diagram of an internal configuration of an image forming apparatus.

FIG. 1 is a schematic diagram of an internal configuration of an image forming apparatus 1 according to an exemplary embodiment of the invention. The image forming apparatus 1 is an apparatus that functions as a copying machine, a printer, a scanner, a facsimile machine, or the like. The image forming apparatus 1 includes, in a housing 100, an accommodating unit 10, feed rollers 20, transport rollers 30, a transfer section 40, a fixing device 50, and ejection rollers 60. The accommodating unit 10 accommodates sheets p (examples of recording media). The feed rollers 20 come into contact with one of the sheets p, which are accommodated in the accommodating unit 10, and feed the sheet p along a transport path r (a chain line in FIG. 1). The transport rollers 30 are members having a cylindrical shape. The transport rollers 30 rotate about their own axes and transport the sheet p, which has been fed by the feed rollers 20. The sheet p passes through the transfer section 40 by being transported by the transport rollers 30. The transfer section 40 transfers a toner image to the sheet p, which has been transported by the transport rollers 30. The fixing device 50 fixes toner onto the sheet p by heating the sheet p to which the toner image has been transferred by the transfer section 40. The ejection rollers 60 eject the sheet p on which the toner has been fixed from the image forming apparatus 1.

The transfer section 40 includes photoconductor drums 401, chargers 402, an exposure device 403, developing devices 404, toner cartridges 405, an intermediate transfer belt 406, a rotating roller 407, first transfer rollers 408, a second transfer roller 409, and a backup roller 410. The photoconductor drums 401 are members having a cylindrical shape, and a photoconductive film is formed on the outer circumferential surface of each of the photoconductor drums 401. The photoconductor drums 401 are supported so as to rotate about their own axes. The photoconductor drums 401 are arranged so as to be in contact with the intermediate transfer belt 406 and rotate in the direction of arrow A1 of FIG. 1 along with a movement of the intermediate transfer belt 406. The chargers 402 are, for example, scorotron chargers and charge the photoconductive films of the photoconductor drums 401 to a predetermined potential. The exposure device 403 exposes the photoconductor drums 401, which have been charged by the chargers 402, to light, thereby forming electrostatic latent images. Each of the developing devices 404 contains a two-component developer containing toner of a corresponding one of yellow (Y), magenta (M), cyan (C), and black (K) and a magnetic carrier such as ferrite powder. The developing devices 404 form toner images by causing the toner to adhere to the electrostatic latent images that have been formed on the photoconductor drums 401. Each of the developing devices 404 is connected to a corresponding one of the toner cartridges 405 via a toner supply path and is replenished with the toner from the corresponding toner cartridge 405 by rotational operation of a dispensing motor (not illustrated). The intermediate transfer belt 406 is a member that is in the form of an endless belt and rotates in the direction of arrow A2 of FIG. 1. The rotating roller 407 is a member having a cylindrical shape and rotates about its own axis. The rotating roller 407 supports the intermediate transfer belt 406 so as to allow the intermediate transfer belt 406 to move. Each of the first transfer rollers 408 is a member having a cylindrical shape and faces a corresponding one of the photoconductor drums 401 across the intermediate transfer belt 406. A transfer bias is applied to each of the first transfer rollers 408 from a power supply (not illustrated), and a potential difference is generated between each of the first transfer rollers 408 and the corresponding photoconductor drum 401. Each of the first transfer rollers 408 transfers the toner image, which has been formed on the surface of the corresponding photoconductor drum 401, to a surface of the intermediate transfer belt 406. The second transfer roller 409 is a member having a cylindrical shape and faces the backup roller 410 across the intermediate transfer belt 406. A transfer bias is applied to the second transfer roller 409 from the power supply (not illustrated), and a potential difference is generated between the second transfer roller 409 and the backup roller 410. The second transfer roller 409 transfers the toner images, which have been transferred on the surface of the intermediate transfer belt 406, to the sheet p.

The image forming apparatus 1 also includes a controller, a communicating unit, and a memory, which are not illustrated in the drawings. The controller controls the operation of each unit of the image forming apparatus 1 described above. The controller includes a central processing unit (CPU), a read only memory (ROM), and a random access memory (RAM). The communicating unit is connected to an external apparatus such as a personal computer or a facsimile machine so as to transmit and receive image data to and from the external apparatus. The memory includes a device that stores data and programs used by the controller, such as a hard disk drive (HDD). With the above configuration, the image forming apparatus 1 forms and fixes toner images on the sheet p through a process in which the sheet p is transported along the transport path r. Hereinbelow, a direction in which the sheet p is to be transported is simply referred to as "a transport direction", and a direction perpendicular to the transport direction is simply referred to as "a width direction".

Figure 2:
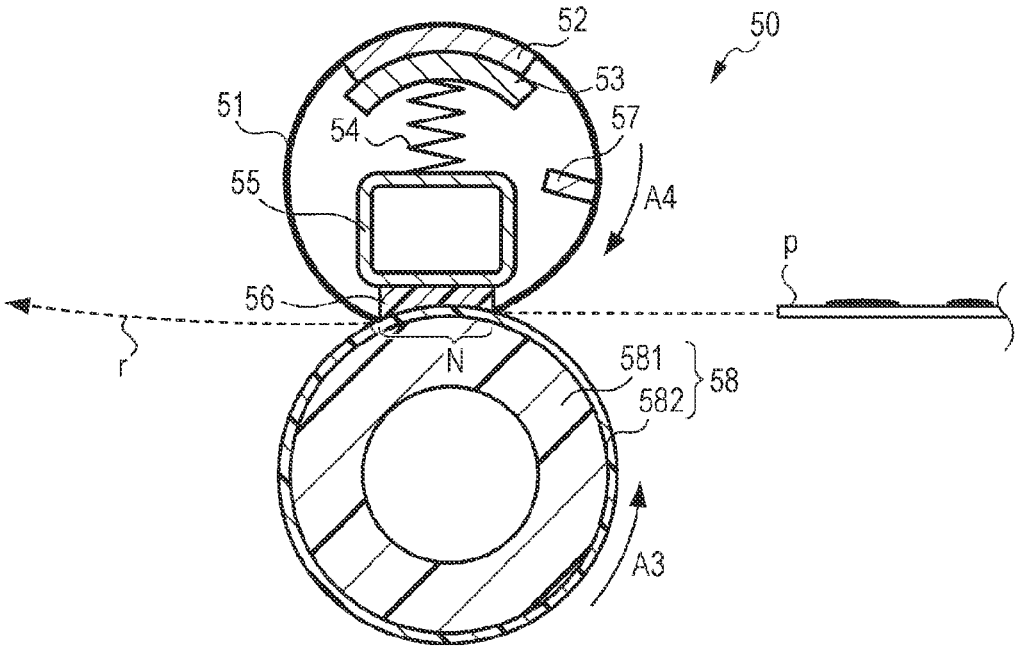
FIG. 2 is a cross-sectional view of a fixing device as viewed from one side in a width direction.

FIG. 2 is a cross-sectional view of the fixing device 50 according to the exemplary embodiment of the invention as viewed from one side in the width direction. The fixing device 50 includes a fixing belt 51, a heater 52, a heater support 53, a pressing member 54, a holder 55, a pressure pad 56, a temperature sensor 57, and a pressure roller 58. The fixing belt 51 is an endless belt that fixes toner onto the sheet p by heat.

Figure 3:
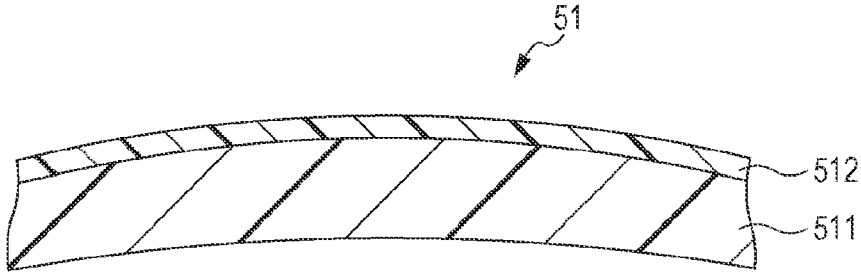
FIG. 3 is an enlarged cross-sectional view of a fixing belt as viewed from one side in the width direction.

FIG. 3 is an enlarged cross-sectional view of the fixing belt 51 according to the exemplary embodiment of the invention as viewed from one side in the width direction. The fixing belt 51 includes, for example, a base material layer 511 and a release layer 512. The base material layer 511 contains a material having heat resistance and flexibility, such as a polyimide, as a base material. A thermally-conductive filler such as aluminum oxide may be dispersed in the base material layer 511. Since the release layer 512 comes into contact with toner images that have been transferred to the sheet p, the release layer 512 is made of a material that allows toner to easily separate therefrom. For example, a layer that is made of tetrafluoroethylene-perfluoroalkyl vinyl ether polymer (PFA), polytetrafluoroethylene (PTFE), a silicone copolymer, or a composite of these materials is used as the release layer 512.

Returning to FIG. 2, the heater 52 (an example of a heating member) is a member in the form of a sheet or substantially a sheet that has flexibility and that heats the fixing belt 51 from inside a space enclosed by the fixing belt 51. The heater 52 includes a resistance heating element made of, for example, aluminum. When electric power is supplied to the heater 52 from the power supply (not illustrated), the heater 52 generates heat. The heat generated by the heater 52 is transferred to the fixing belt 51.

The heater support 53 (an example of a stationary member) has a curved surface that is in contact with the heater 52 and has a coefficient of linear expansion different from that of the heater 52. The heater 52 is fixed to the heater support 53 in a part of an area in which the heater 52 and the heater support 53 are in contact with each other. An area in which the heater 52 and the heater support 53 are fixed to each other in the area in which the heater 52 and the heater support 53 are in contact with each other will be hereinafter referred to as "a fixed area". An area in which the heater 52 and the heater support 53 are not fixed to each other in the area in which the heater 52 and the heater support 53 are in contact with each other will be hereinafter referred to as "a non-fixed area". The heater support 53 and the heater 52 are adhered to each other with, for example, an adhesive. The heater support 53 has a rigidity greater than those of the fixing belt 51 and the heater 52. In FIG. 2, the heater support 53 is a member in the form of a sheet. The fixing belt 51 is wound around the heater support 53 via the heater 52.

The pressing member 54 is a member that is in contact with the heater support 53 at one end so as to press the heater support 53 against the heater 52 and the fixing belt 51. For example, the pressing member 54 may be a coil spring. Plural coil springs are arranged in the width direction. The other end of each of the pressing members 54 that is not in contact with the heater support 53 is fixed to the holder 55.

As described above, the rigidities of the fixing belt 51 and the heater 52 are lower than that of the heater support 53. Therefore, when the fixing belt 51 is wound around the heater support 53 via the heater 52, and the pressing members 54 press the heater support 53 against the heater 52 and the fixing belt 51, the heater 52 is bent along the curved surface of the heater support 53.

The pressure pad 56 is made of an elastic body such as silicone rubber or fluoro rubber and is supported by the holder 55 in such a manner as to face the pressure roller 58 that will be described below. The pressure pad 56 is positioned in such a manner as to be pressed by the pressure roller 58 via the fixing belt 51, and a nip area N is defined between the pressure pad 56 and the pressure roller 58. The temperature sensor 57 is a sensor such as a thermistor that is mounted on the fixing belt 51 in order to measure the temperature of the fixing belt 51.

The pressure roller 58 is a member having a cylindrical shape that applies pressure to the sheet p in the nip area N defined between the pressure roller 58 and the fixing belt 51. The pressure roller 58 is positioned in such a manner as to face the fixing belt 51. The nip area N is formed when the pressure roller 58 is brought into contact with the fixing belt 51 by a drive mechanism that is not illustrated in the drawings. The pressure roller 58 rotates in the transport direction (the direction of arrow A3 of FIG. 2) at the speed at which the sheet p is transported by the transport rollers 30. When the pressure roller 58 rotates, the fixing belt 51 is driven by the pressure roller 58 and rotates in the direction of arrow A4 of FIG. 2 (an example of a specific direction). The pressure roller 58 includes an elastic body layer 581 and a release layer 582. The elastic body layer 581 is made of a material having heat resistance and elasticity such as foamed silicone rubber. The release layer 582 is a layer that comes into contact with the sheet p, and is made of a material that allows the sheet p to easily separate therefrom. For example, a heat resistant resin coating such as a carbon-containing PFA or a heat resistant rubber coating is used as the release layer 582.

Figure 4:
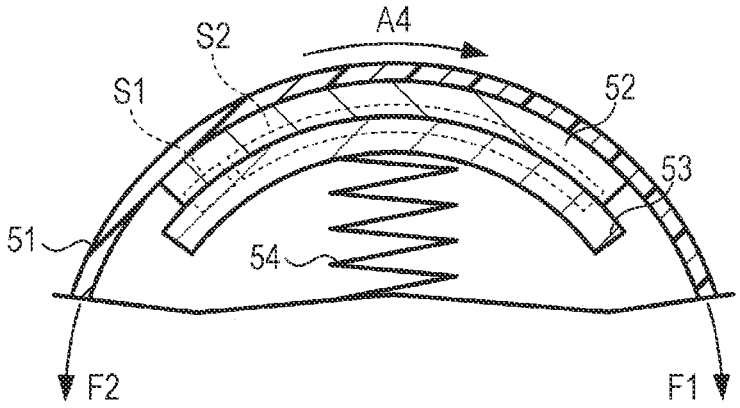
FIG. 4 is an enlarged view of the fixing device as viewed from one side in the width direction.
Figure 5:
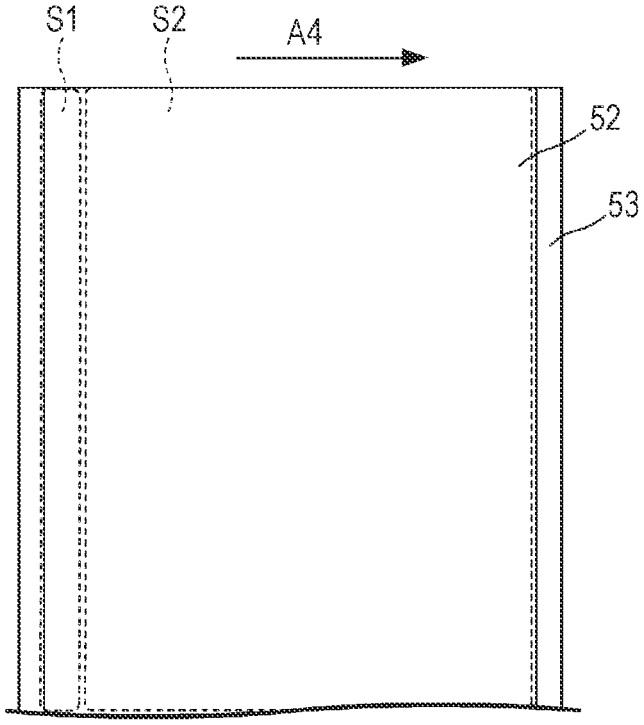
FIG. 5 is a diagram illustrating a heater and a heater support as viewed from the side of the heater.

FIG. 4 is an enlarged view of the fixing device 50 as viewed from one side in the width direction. FIG. 5 is a diagram illustrating the heater 52 and the heater support 53 as viewed from the side of the heater 52. An area S1 defined by a dashed line in FIG. 5 represents the fixed area. As illustrated in FIG. 5, the fixed area is formed in such a manner as to extend from one side to the other side in the width direction. An area S2 defined by another dashed line represents the non-fixed area. As illustrated in FIG. 4 and FIG. 5, the heater 52 is fixed to the heater support 53 such that the fixed area is positioned more upstream than the non-fixed area in a direction in which the fixing belt 51 rotates (the direction of arrow A4 of FIG. 4). In other words, the heater 52 is fixed to the heater support 53 such that the non-fixed area is positioned more downstream than the fixed area in the direction of arrow A4 of FIG. 4. In the case illustrated in FIG. 4 and FIG. 5, the fixed area includes an end portion of the heater 52 on the upstream side in the direction of arrow A4 of FIG. 4. In other words, the end portion of the heater 52 on the upstream side in the direction of arrow A4 of FIG. 4 is fixed to the heater support 53.

As illustrated in FIG. 4, when the pressing members 54 press the heater support 53, tension is applied to the fixing belt 51 in the directions of arrow F1 and arrow F2 of FIG. 4. When the pressure roller 58 rotates, tension is further applied to the fixing belt 51 in the direction of arrow F1 of FIG. 4, so that the fixing belt 51 rotates in the direction of arrow A4 of FIG. 4. Each of the pressing members 54 that applies tension to the fixing belt 51 and the pressure roller 58 are examples of applying units. When the fixing belt 51 rotates, the fixing belt 51 applies tension to the heater 52 in the direction of arrow A4 of FIG. 4. Thus, even if the heater 52 and the heater support 53 have coefficients of linear expansion different from each other, a decrease in the degree of contact between the heater 52 and the heater support 53 may be suppressed as compared with the case where the whole area in which the heater 52 and the heater support 53 are in contact with each other is the fixed area. In the case where a decrease in the degree of contact between the heater 52 and the heater support 53 is suppressed, a decrease in the degree of contact between the fixing belt 51 and the heater 52 may also be suppressed.

Modification

The present invention is not limited to the above-described exemplary embodiment, and various modifications may be made. Some modifications will now be described below. Two or more modifications among the following modifications may be employed in combination.

(1) Modification 1

The fixed area in which the heater 52 and the heater support 53 are fixed to each other is not limited to one area. The heater 52 and the heater support 53 may be fixed to each other in multiple areas. In the above-described exemplary embodiment, an example of the fixed area extending in the width direction has been described. However, the fixed area may have any shape.

(2) Modification 2

A material of the resistance heating element in the heater 52 is not limited to aluminum. A resistance heating element in the heater 52 may be made of copper, nickel, chrome, or the like. In the heater 52, the resistance heating element may be covered with a material having heat resistance and flexibility such as silicone or polyimide.

(3) Modification 3

The member that heats the fixing belt 51 is not limited to the heater 52. The member that heats the fixing belt 51 may be, for example, a heat storage plate that is to be heated by electromagnetic induction. In this case, a coil that generates an alternating magnetic field for causing the heat storage plate to generate heat is provided in the fixing device 50. As in the case of the heater 52, the heat storage plate is disposed so as to face and be in contact with the inner circumferential surface of the fixing belt 51. Alternatively, the fixing belt 51 may include a conductive heat generating layer that is to be heated by electromagnetic induction.

(4) Modification 4

The member via which the fixing belt 51 is wound around the heater support 53 need not be only the heater 52. The fixing belt 51 may be wound around the heater support 53 via a layer that includes the heater 52. For example, a plate for protecting the heater 52 may be provided between the fixing belt 51 and the heater 52.

(5) Modification 5

The heater support 53 is not limited to be a member in the form of a sheet. For example, the heater support 53 may be a semicylindrical member extending in the width direction and having a curved surface that is in contact with the heater 52.

(6) Modification 6

The structures of the fixing belt 51 and the pressure roller 58 are not limited to those described in the exemplary embodiment. For example, the fixing belt 51 need not include the release layer 512.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising;

an endless belt configured to fix toner onto a recording medium using heat;

a heating member comprising a sheet that has flexibility and that is configured to heat the belt from inside a space enclosed by the belt; and a stationary member including:

a curved surface that is in contact with the heating member;

a fixed area of the curved surface at which the heating member is fixed to the stationary member; and a non-fixed area of the curved surface at which the heating member is not fixed to the stationary member, wherein the stationary member has a coefficient of linear expansion different from a coefficient of linear expansion of the heating member, wherein the belt is wound around the stationary member via a layer that includes the heating member, wherein rigidities of the belt and the heating member are lower than a rigidity of the stationary, wherein the belt is configured to rotate in a specific direction, and wherein the fixed area is positioned more upstream than the non-fixed area in the specific direction.

2. The fixing device according to claim 1, further comprising:

an applying unit is configured to apply tension to the belt in the specific direction.

3. The fixing device according to claim 2, wherein the belt is configured to apply tension to the layer that includes the heating member in the specific direction.

4. A fixing device comprising:

an endless belt configured to fix toner onto a recording medium using heat;

a heating member comprising a sheet that has flexibility and that is configured to heat the belt from inside a space enclosed by the belt; and a stationary member including:

a curved surface that is in contact with the heating member;

a fixed area of the curved surface at which the heating member is fixed to the stationary member; and a non-fixed area of the curved surface at which the heating member is not fixed to the stationary member, wherein the stationary member has a coefficient of linear expansion different from a coefficient of linear expansion of the heating member, wherein the belt is wound around the stationary member via a layer that includes the heating member, wherein rigidities of the belt and the heating member are lower than a rigidity of the stationary member, wherein the belt is configured to rotate in a specific direction, and wherein the non-fixed area is positioned more downstream than the fixed area in the specific direction.

5. The fixing device according to claim 4, further comprising:

an applying unit is configured to apply tension to the belt in the specific direction.

6. The fixing device according to claim 5, wherein the belt is configured to apply tension to the layer that includes the heating member in the specific direction.

7. A fixing device comprising:

an endless belt configured to fix toner onto a recording medium using heat;

a heating member comprising a sheet that has flexibility and that is configured to heat the belt from inside a space enclosed by the belt; and a stationary member including:

a curved surface that is in contact with the heating member;

a fixed area of the curved surface at which the heating member is fixed to the stationary member; and a non-fixed area of the curved surface at which the heating member is not fixed to the stationary member, wherein the stationary member has a coefficient of linear expansion different from a coefficient of linear expansion of the heating member, wherein the belt is wound around the stationary member via a layer that includes the heating member, wherein rigidities of the belt and the heating member are lower than a rigidity of the stationary member, wherein the belt is configured to rotate in a specific direction, and wherein the fixed area includes an end portion of the heating member on an upstream side in the specific direction.

8. The fixing device according to claim 7, further comprising:

an applying unit is configured to apply tension to the belt in the specific direction.

9. The fixing device according to claim 8, wherein the belt is configured to apply tension to the layer that includes the heating member in the specific direction.

* * * * *